US006891118B2

(12) United States Patent
Wecke et al.

(10) Patent No.: US 6,891,118 B2
(45) Date of Patent: May 10, 2005

(54) MANUALLY OPERABLE ELECTRICAL OPERATING MEMBER

(75) Inventors: Rolf Wecke, Bückeburg (DE); Jürgen Weiss, Lübbecke (DE); Micahel Leuschner, Minden (DE)

(73) Assignee: Bernstein AG, Porta Westfalica (DE)

( * ) Notice: Subject to any disclaimer, the term of this patent is extended or adjusted under 35 U.S.C. 154(b) by 0 days.

(21) Appl. No.: 10/454,543

(22) Filed: Jun. 5, 2003

(65) Prior Publication Data

US 2003/0234170 A1 Dec. 25, 2003

(30) Foreign Application Priority Data

Jun. 5, 2002 (DE) ..... 202 08 683 U

(51) Int. Cl.[7] ..... H01H 13/68
(52) U.S. Cl. ..... 200/518; 200/552; 200/334
(58) Field of Search ..... 200/518, 519, 200/520, 552, 573, 574, 334

(56) References Cited

U.S. PATENT DOCUMENTS 1,901,385 A * 3/1933 George et al. ..... 200/518
3,109,901 A * 11/1963 Strauss ..... 200/519
3,737,604 A * 6/1973 Dietrich et al. ..... 200/518
5,349,147 A * 9/1994 Gallone ..... 200/552
5,579,899 A 12/1996 Arnold
5,655,649 A * 8/1997 Lazzer ..... 200/552
6,713,703 B1 * 3/2004 Roza ..... 200/520

FOREIGN PATENT DOCUMENTS

| | | |
|---|---|---|
| DE | 35 13 964 A1 | 10/1986 |
| DE | 196 15 682 A1 | 10/1997 |
| JP | 11077579 | 3/1999 |

* cited by examiner

*Primary Examiner*—Michael A. Friedhofer
(74) *Attorney, Agent, or Firm*—Barnes & Thornburg LLP

(57) ABSTRACT

A manually operable, electrical operating member having two key buttons for the respective switching-on and switching-off of the current, which key buttons are arranged on mutually opposite sides and can be operated in several steps. A common, mechanically operable switch is provided with which the key buttons are each in an operative connection.

10 Claims, 3 Drawing Sheets

MANUALLY OPERABLE ELECTRICAL OPERATING MEMBER

CROSS-REFERENCE

This non-provisional application claims priority to German Application No. 220 08 683.6 filed Jun. 5, 2002, which is hereby incorporated by reference.

BACKGROUND AND SUMMARY OF THE INVENTION

Operating members of this type are used in many different application fields, for example, as a manual operation terminal.

Such operating members are distinguished mainly by the possibilities of an optionally right-handed or left-handed operation. For this purpose, one key button respectively is provided on the mutually opposite sides to switch a unit on and off and is connected to the operating member.

In addition to the requirement of having an emergency off push button, it is also necessary to design the key button such that the switch is switched-off when panic-caused reflex-type continued pressing takes place onto the key button.

In this case, the key button is pressed down and held for the purpose of a switch-on, and it rebounds into a switch-off position when it is released. In the event of a panic reaction and the above-mentioned continued unintentional further depression of the key button, a switch-off should, however, also take place.

In order to permit this sequence, a high-cost electronic system has been used, particularly since it has to be possible to implement the above-mentioned switchings of both key buttons independently of one another.

The electronic system required so far naturally results in considerable manufacturing costs which are found to be disadvantageous since the concerned operating members are used in large quantities.

However, with respect to the operation, the electronic components are also interference-prone. They also require special constructive protection measures, that is, casing measures in order to protect them from the occasionally rough operation in which such operating members are used.

It is therefore an object of the present invention to further develop an operating member of the above-mentioned type such that it has a simple construction, can therefore be produced in a cost-effective manner and is operationally robust.

This operating member is an extremely simple construction with respect to its switching-on because an electronic system can be completely eliminated.

The exclusively mechanical switching device can be produced and mounted in a simple manner. Furthermore, it is a robust construction which results in a low susceptibility to interferences and in a long service life.

According to an advantageous further development of the invention, the switch can be operated by two mutually independently operating switching elements. Each switching element is connected with one of the two key buttons.

This independence of the switching elements permits an equally independent operation of the key buttons on the right or the left side.

The switch may be arranged in a central manner, in which case the key buttons and the switching elements fastened thereto are mounted mirror image or symmetrically.

In principle, the electrical switch, operating as a safety switching device, may be arranged in a housing on whose exterior side recessed grips are fastened which carry the key buttons. The switching elements may be movable by an operating linkage.

In its operating sequence, the switch is conceived such that, after the operation of the panic switching device, during the subsequent restoring into the switched-off position, it skips over the switched-on position.

It is also conceivable to release the switch from the panic position by a separate unlocking, preferably a manual unlocking, also by skipping the switched-on position.

Depending on the space requirements, the switch may also be mounted in a decentralized manner with respect to the key buttons in a housing. In this case, respectively suitable driving elements are to be provided by which the key buttons can be brought into an operative connection with the switch.

In addition to taking place by means of the above-mentioned switching elements, the operation of the switch may also take place by curves, connecting links or the like whose construction, like that of the switching elements, depends on the constructional conditions and in each case has to be individually conceived.

These and other aspects of the present invention will become apparent from the following detailed description of the invention, when considered in conjunction with accompanying drawings.

DETAILED DESCRIPTION OF THE PREFERRED EMBODIMENTS

Figure 1:
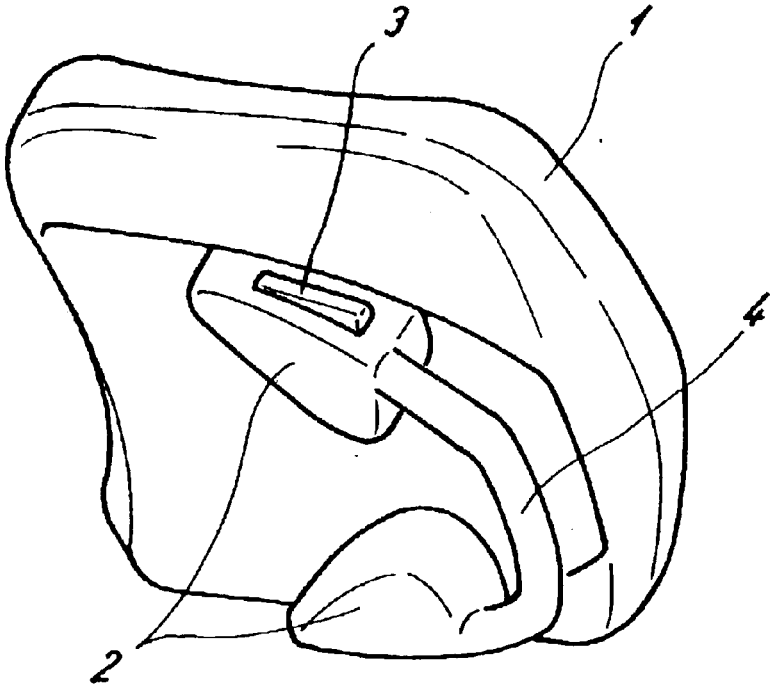
FIG. 1 is a perspective bottom view of an operating member according to the invention.
Figure 2:
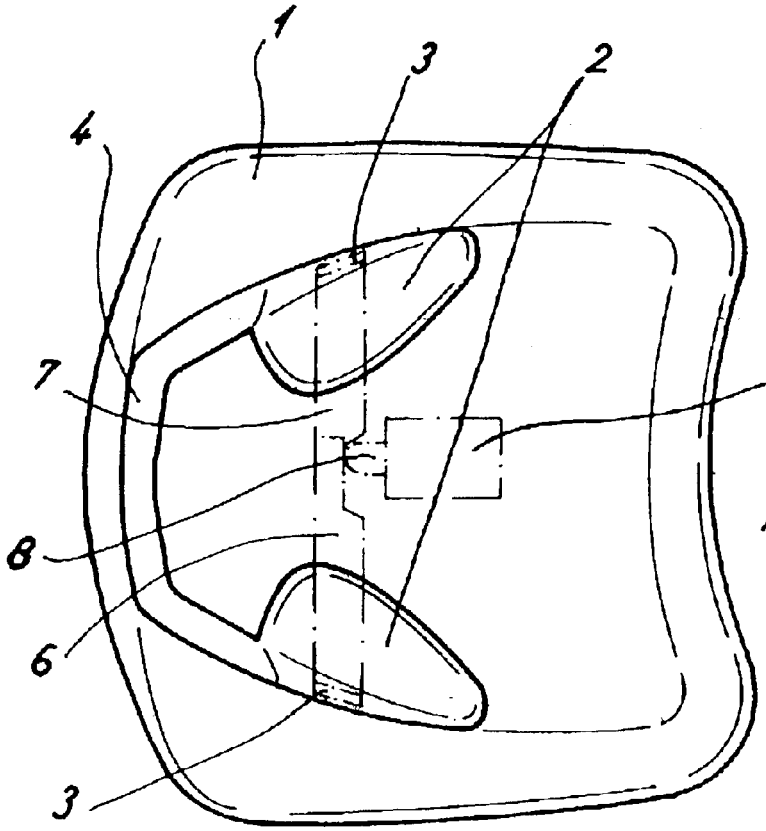
FIG. 2 is a bottom view of the operating member with the schematically illustrated switch.

FIGS. 1 and 2 show a manually operable electrical operating member in the form of a manual operation terminal which has a housing 1 as well as two grips 2 on the bottom side, which are connected with one another by a bridge 4.

On the exterior side of the mutually opposite grips 2, one key button 3 respectively for the right-handed and left-handed operation is arranged. The key buttons 3 are in an operative connection with a common mechanically operable switch 5 which, in the present embodiment, is arranged in the housing 1. Current for the operation of a unit connected to the operating member can be switched on and off by switch 5.

Figure 3:
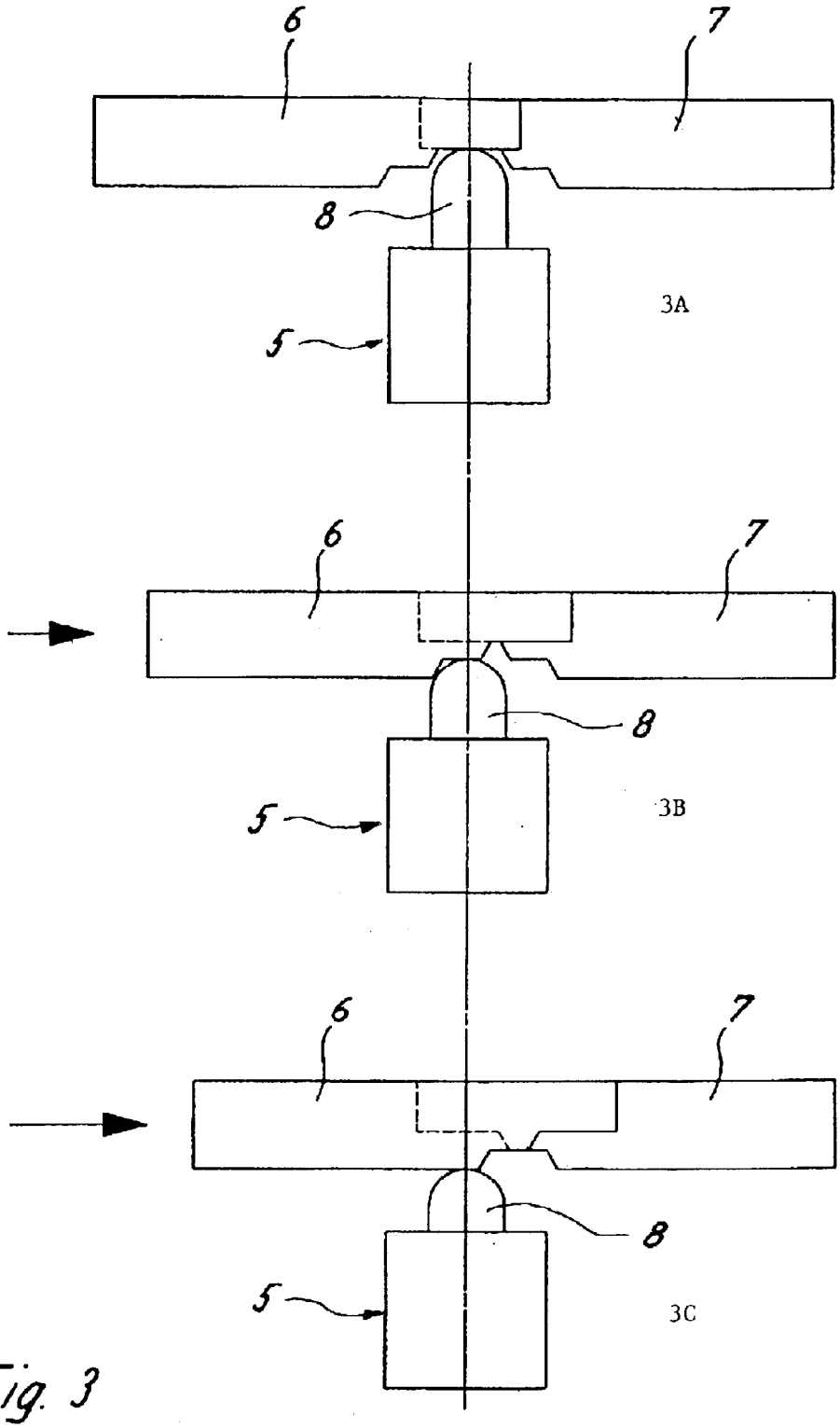
FIGS. 3A–3C are schematic views of an embodiment of the invention in various positions of the switch.

As schematically illustrated in FIG. 2, the operation of the switch 5 takes place by rod-shaped switching elements 6, 7, also shown in FIG. 3, which are connected with a respective key button 3.

On one end, each switching element 6, 7 is constructed in the manner of a curve which overlaps and rests against a sliding head 8 of the switch 5. In this case, the switching elements 6, 7 can be displaced independently of one another; that is, each key button 3 can be operated separately.

The illustration in FIG. 3A shows a position in which the switch 5 is switched off. The sliding head 8 takes up a maximally extended position, and the current is interrupted. This position represents a so-called rest position.

In the operative position of FIG. 3B, the key button 3, which is not shown, was operated to advance the switching element 6 onto the sliding head 8. By sliding head 8 being pressed-in, the switch 5 is switched on or a connected electric circuit is closed and circuit flows.

The illustration in FIG. 3C shows a so-called panic position in which the switching element 6 is pressed through to an end stop in the direction of the arrow. This may occur in the event of reflex-type panic reactions. In this position of sliding head 8 which is further pressed-in, the switch 5 is also switched off and the current conduction is interrupted.

As illustrated, the switching element 7, which is assigned to the other key button 3, is not affected by the corresponding movement of the switching element 6. That is, an operation of the switch 5 by the respective key buttons 3 takes place individually, independently of the position of the respective other key button 3.

Figure 4:
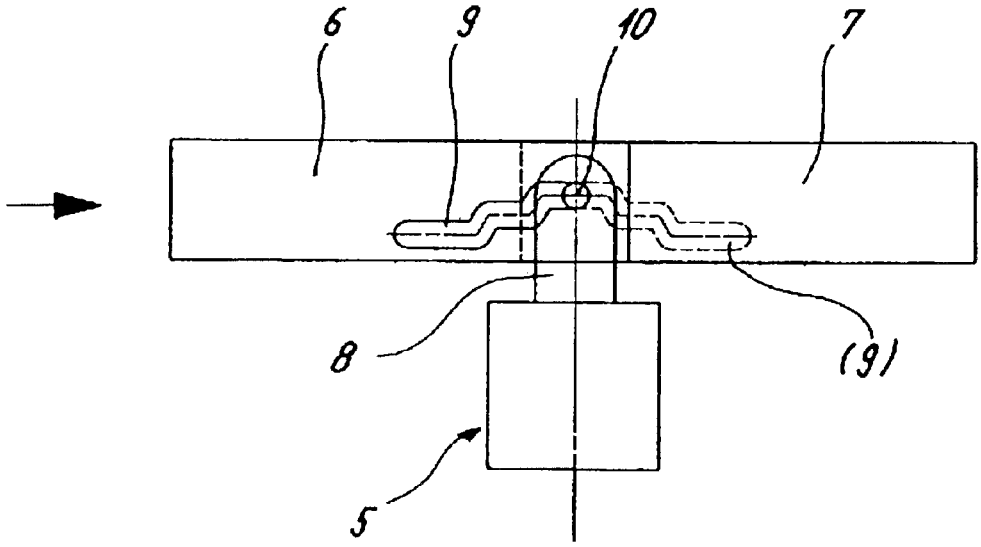
FIG. 4 is a schematic top view of another embodiment of the invention.

In the embodiment illustrated in FIG. 4, each switching element 6, 7 has a connecting link guide 9 in which a connecting link pin 10 of the sliding head 8 is guided in a form-locking manner.

Instead of the direct three-step switching illustrated in the examples, it is also possible to indirectly trigger the switch 5 by suitable transmission parts, such as control levers, or the like.

Although the present invention has been described and illustrated in detail, it is to be clearly understood that this is done by way of illustration and example only and is not to be taken by way of limitation. The scope of the present invention is to be limited only by the terms of the appended claims.

What is claimed is:

1. A manually operable electrical operating member comprising:

two key buttons arranged on mutually opposite sides of the member which can be operated in several steps; and a common, mechanically operable switch with which the key buttons are each in an operative connection to switch-on and switch-off current through the switch; and wherein the switch is constructed as a three-step switch.

2. The operating member according to claim 1, wherein the switch is switched off in both end positions of the key buttons.

3. The operating member according to claim 1, wherein the switch steps are, in order: off, on and off.

4. A manually operable electrical operating member comprising:

two key buttons arranged on mutually opposite sides of the member which can be operated in several steps; and a common, mechanically operable switch with which the key buttons are each in an operative connection to switch-on and switch-off current through the switch; and wherein the switch is arranged in a central position relative to the key buttons.

5. A manually operable electrical operating member comprising:

two key buttons arranged on mutually opposite sides of the member which can be operated in several steps;

a common, mechanically operable switch with which the key buttons are each in an operative connection by a switching element to switch-on and switch-off current through the switch; and wherein each of the switching elements has a control curve by which the switch can be triggered.

6. The operating member according to claim 5, wherein each of the switching elements includes a connecting link guide in which a connecting link pin of the switch is guided for the operation of the switch.

7. The operating member according to claim 5, wherein the switching elements move independently of one another.

8. The operating member according to claim 5, wherein the switch is a three-step switch, and the curve corresponds to the three steps.

9. A manually operable electrical operating member comprising:

two key buttons arranged on mutually opposite sides of the member which can be operated in several steps;

a common, mechanically operable switch with which the key buttons are each in an operative connection to switch-on and switch-off current through the switch; and wherein the switch can be brought from a panic position into an off-position, while skipping an on-position.

10. A manually operable electrical operating member comprising:

a three-step switch;

two key buttons on opposite sides of the member and operable in three steps; and switching elements, each of the switching elements operatively connects a respective one of the key buttons to and operates the switch to one of the three switch steps.

* * * * *